US006750568B2

(12) United States Patent
Ohara

(10) Patent No.: US 6,750,568 B2
(45) Date of Patent: Jun. 15, 2004

(54) REMOTE CONTROLLED AUXILIARY LOCK

(75) Inventor: Takanori Ohara, Aichi (JP)

(73) Assignee: Union Corporation, Osaka (JP)

( * ) Notice: Subject to any disclaimer, the term of this patent is extended or adjusted under 35 U.S.C. 154(b) by 229 days.

(21) Appl. No.: 10/086,445

(22) Filed: Mar. 4, 2002

(65) Prior Publication Data

US 2002/0121974 A1 Sep. 5, 2002

(30) Foreign Application Priority Data

Mar. 5, 2001 (JP) ..... 2001-060453

(51) Int. Cl.[7] ..... H01H 3/26
(52) U.S. Cl. ..... 307/143; 307/141.4; 70/271
(58) Field of Search ..... 307/139, 141.4, 307/143; 70/280, 271, 275; 340/5.31, 5.7

(56) References Cited

U.S. PATENT DOCUMENTS

| | | | | |
|---|---|---|---|---|
| 5,678,436 A | * | 10/1997 | Alexander | 70/278.3 |
| 5,867,107 A | * | 2/1999 | Gartner | 340/5.31 |
| 6,046,681 A | * | 4/2000 | Solop | 340/5.26 |
| 6,381,999 B1 | * | 5/2002 | Doong | 70/107 |

FOREIGN PATENT DOCUMENTS

| | | | |
|---|---|---|---|
| DE | 199 37 034 | | 2/2001 |
| EP | 0 346 317 A2 | * | 12/1989 |
| GB | 2 277 960 | | 11/1994 |
| GB | 2 347 667 | | 9/2000 |
| JP | 09-165949 | * | 6/1997 |
| WO | 96/41486 | | 12/1996 |
| WO | 99/53161 | | 10/1999 |

OTHER PUBLICATIONS

English translation of JP 09–165949, Electronic Lock, Published Jun. 1997, inventor: Yasumichi et al.*

* cited by examiner

*Primary Examiner*—Gregory J. Toatley, Jr.
*Assistant Examiner*—Sharon A. Polk
(74) *Attorney, Agent, or Firm*—Wenderoth, Lind & Ponack, L.L.P.

(57) ABSTRACT

With an auxiliary lock operated by a built-in battery, it is desired to prevent the door from being kept locked even if the battery dies. The auxiliary lock body is provided with first and second voltage detecting means for detecting that the voltage of the battery has lowered to predetermined voltages. If the first voltage detecting means detects that the voltage of the battery has dropped to a predetermined voltage, the fact is alarmed. Then, if the second voltage detecting means detects that the voltage of the battery has dropped further, the actuator is activated to open the lock by pushing down the bolt inside the lock surface before the battery dies, thereby preventing the door from being kept locked even if the battery dies.

7 Claims, 11 Drawing Sheets

REMOTE CONTROLLED AUXILIARY LOCK

BACKGROUND OF THE INVENTION

This invention relates to a remote controlled auxiliary lock effective in particular against theft such as by picking.

In recent years, damage due to picking is increasing. Picking is an act in which a special tool is inserted into a keyhole to open the lock in an extremely short period of time for theft, and the damage is large because the entrance door is opened and things in rooms can be completely stolen.

In order to prevent damage due to picking, one conceivable method is to replace the lock with a dimple type or magnetic type one which is more difficult to pick.

But for this method, a special tool or a specialist is needed for replacement. Also, some type of locks cannot be replaced.

As a simple method, it is conceivable to mount a plurality of auxiliary locks so that it takes a longer time to open the locks, thereby making thieves hesitate to enter.

But even if a plurality of auxiliary locks are provided, since they have keyholes, it is not impossible to open them by use of a tool. Further, if a plurality of auxiliary locks are provided, it is time-consuming to open and close such locks in daily lives.

Thus, a remote control type auxiliary lock is conceivable. For example, if a lock can be opened and closed by a remote controller, since the lock has no keyhole, it is impossible to open it even if a tool is used. Further, the lock can be opened and closed quickly.

But for a remote control type lock, a power source is necessary to drive the auxiliary lock. It is conceivable to use an AC power source for such a power source. But wiring is necessary and there may be no outlet in the hall. Thus, it is preferably battery-driven.

But in the case of battery driving, there is a problem that if the battery dies with the lock fastened, it is impossible to open it.

Also, if the batteries die in a short period of time, they have to be replaced frequently. Replacing them will be time-consuming and maintenance cost will be high. This markedly reduces the merit of the remote control type.

An object of this invention is to prevent the door from being kept shut even if the battery dies and to make it possible to use for a long time with a battery.

SUMMARY OF THE INVENTION

According to this invention, there is provided a remote controlled auxiliary lock comprising an auxiliary lock body mounted to a door and a wireless remote controller, the lock body comprising a bolt protrudable from a lock surface, an actuator for actuating the bolt, a lock seat engageable with the bolt, and a built-in battery for activating the actuator, the auxiliary lock body comprising a wireless receiver means, a drive means for activating the actuator when the wireless receiver means receives an open-close signal from the wireless remote controller, a first voltage detecting means and a second voltage detecting means for detecting that the voltage of the battery has lowered to respective predetermined voltages, and an alarm means, the wireless remote controller comprising a wireless transmission means and an open-close signal generating means for sending the open-close signal to the wireless transmission means, wherein when the first voltage detecting means detects that the voltage of the battery has dropped to a predetermined first voltage, an alarm is generated by the alarm means, and when the second voltage detecting means detects that the voltage of the battery has dropped further to a predetermined second voltage, the actuator is activated to push down the bolt inside the lock surface.

With this arrangement, when the first voltage detecting means detects that the voltage of the battery has dropped to a predetermined level at which replacement is necessary, an alarm is generated by the alarm means, which uses sound or light to urge replacement of the battery.

If the battery is not replaced even after the alarm is generated, when the second voltage detecting means detects a predetermined second voltage, e.g. a minimum voltage at which the actuator can be activated, the actuator is activated to withdraw the bolt inside the lock surface. Thus, it is possible to prevent the door from being kept closed even if the battery dies. At this time, while the auxiliary lock becomes ineffective, the door is locked by its main lock.

By providing the auxiliary lock body with an electric power supply means for intermittently supplying electric power from the built-in battery to the wireless receiver means to activate it, it is possible to prevent trouble in receiving signals while retarding exhaustion of the battery, so that it is possible to use the lock for a long time without replacing the battery.

Further, by driving the actuator by means of a motor through a clutch mechanism, it is possible to push down the bolt by releasing the coupling of the actuator and the motor with the clutch mechanism, so that the lock can be opened from inside the door without using remote control.

Also, by providing the auxiliary lock body with an ID distinguishing means and providing the wireless remote controller with an ID signal generating means, the auxiliary lock can be operated only by a specific remote controller. Thus, for example, it is possible to make it difficult to manufacture a remote controller for a duplicate key by complicating the code signal used for the ID signal. Further, for example, if it is designed such that the body will not be activated unless it continuously receives identical ID signals twice (or N times) at a constant speed, it is possible to easily strengthen security.

Other features and objects of the present invention will become apparent from the following description made with reference to the accompanying drawings, in which:

DETAILED DESCRIPTION OF THE PREFERRED EMBODIMENT

An embodiment of this invention will be described with reference to the drawings.

Figure 1:
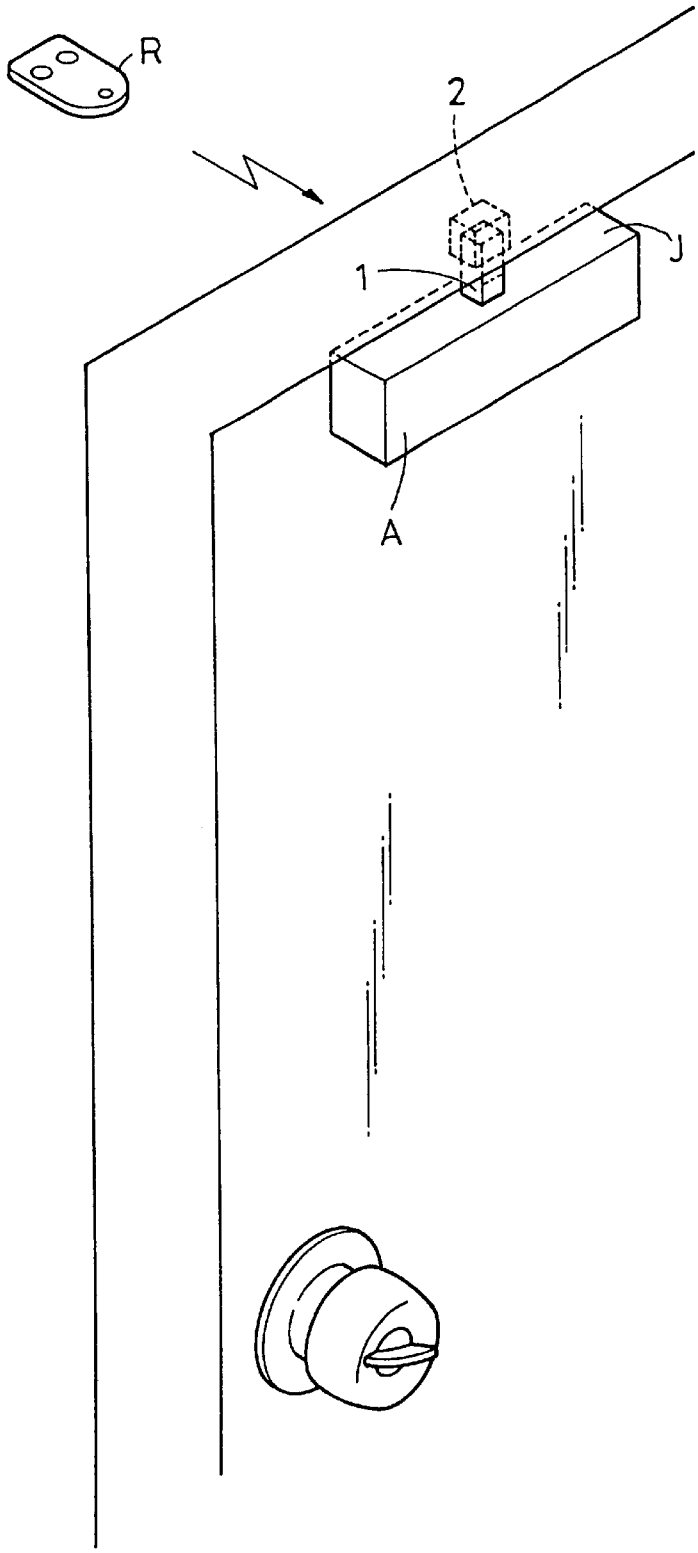
FIG. 1 is a perspective view of an embodiment.

As shown in FIG. 1, the remote controlled auxiliary lock of this embodiment is mounted on the inside of a door. It comprises an auxiliary lock body A and a wireless remote controller R. The lock body A has a bolt 1 protrudable from a lock surface J so as to be engageable with a lock seat 2.

Figure 2:
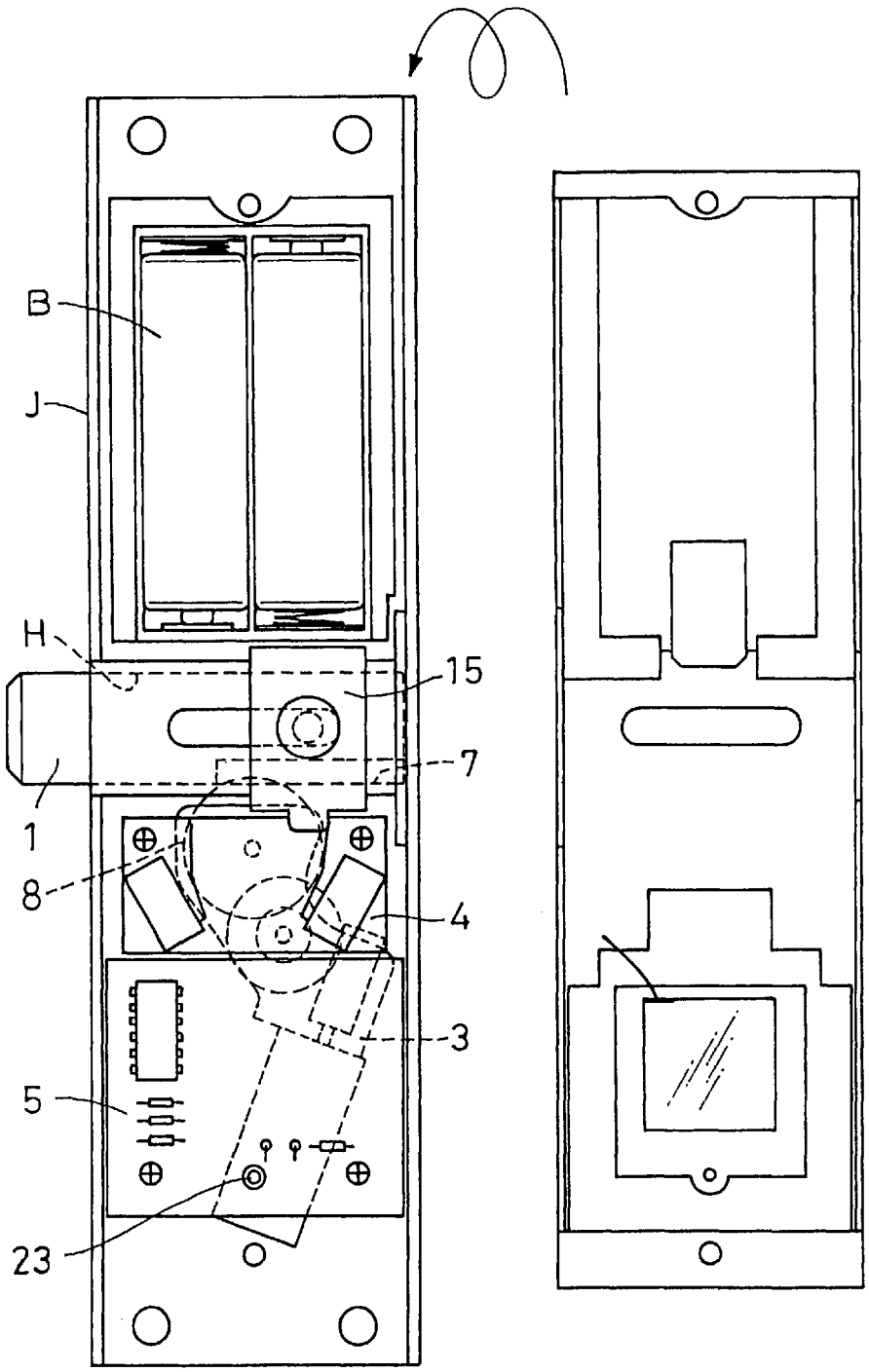
FIG. 2 is a plan view of the same.

In the auxiliary lock body A, as shown in FIG. 2, a battery B (DC 3V in this embodiment), the bolt 1, an actuator 3, a sensor switch 4, a circuit board 5, etc. are housed. Mounting holes are formed at four corners of the case so that it can be fastened to a door.

As shown in FIG. 2, the bolt 1 is received in a guide hole H and is supported so as to be protrudable and retractable. On the side of the bolt 1, a rack gear 7 is formed as shown by chain line so as to be disposed in a slit formed in the guide hole H. Through this slit, a pinion gear 8 of the actuator 3 is adapted to engage the rack gear 7 of the bolt 1.

Figure 3C:
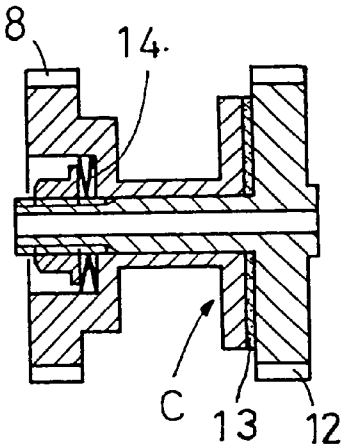
FIG. 3C is a partial sectional view of the same.
Figure 3B:
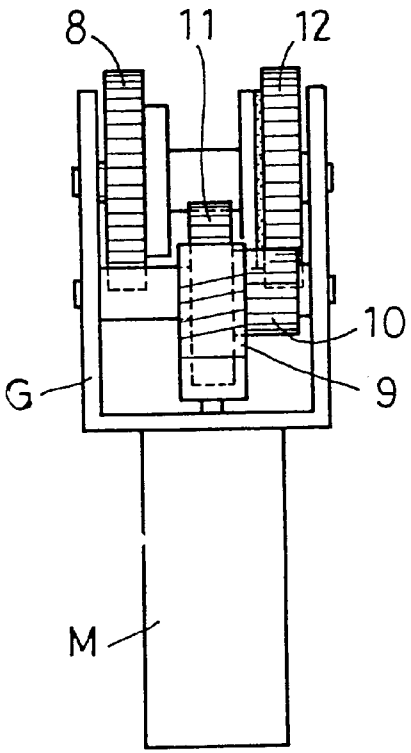
FIG. 3B is a back view of the portion of the same.
Figure 3A:
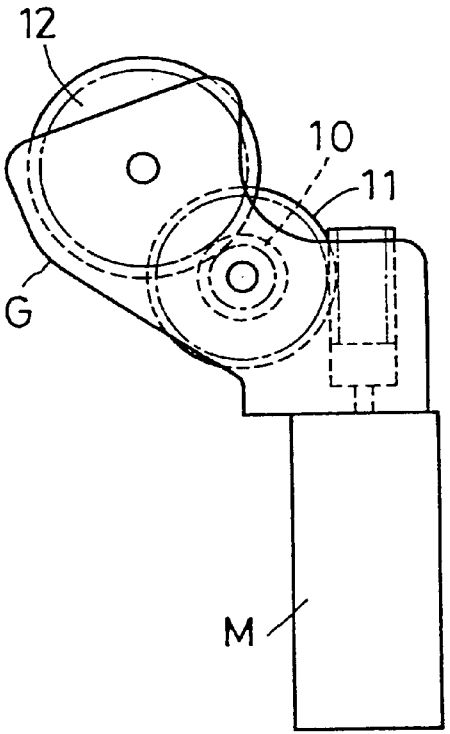
FIG. 3A is a front view of a portion of the same.

As shown in FIGS. 3A and 3B, the actuator 3 has a motor M provided with a speed reducer G, which is provided with a clutch mechanism C as shown in FIG. 3C.

The speed reducer G is comprised of a worm gear 9, a spur gear 10 and pinion gears 8 and 11. The rotation of the worm gear 9, which is mounted on the rotary shaft of the motor M, is transmitted to a gear 12 through the spur gear 10, which is coaxial with the pinion gear 11, so that the pinion gear 8, which is connected to the gear 12 through the clutch mechanism C, is turned.

The clutch mechanism C is a friction clutch having a friction member 13 such as a rubber plate. As shown in FIG. 3C, the pinion gear 8 has an engaging portion pressed against the gear 12 through the friction member 13 by an elastic member such as a spring 14.

With this arrangement, when a predetermined turning force is applied to the pinion gear 8, the clutch mechanism C slips, so that it is possible to turn the pinion gear 8. Thus, even if the actuator 3 does not operate, it is possible to open the lock by pushing down the bolt 1.

Figure 4:
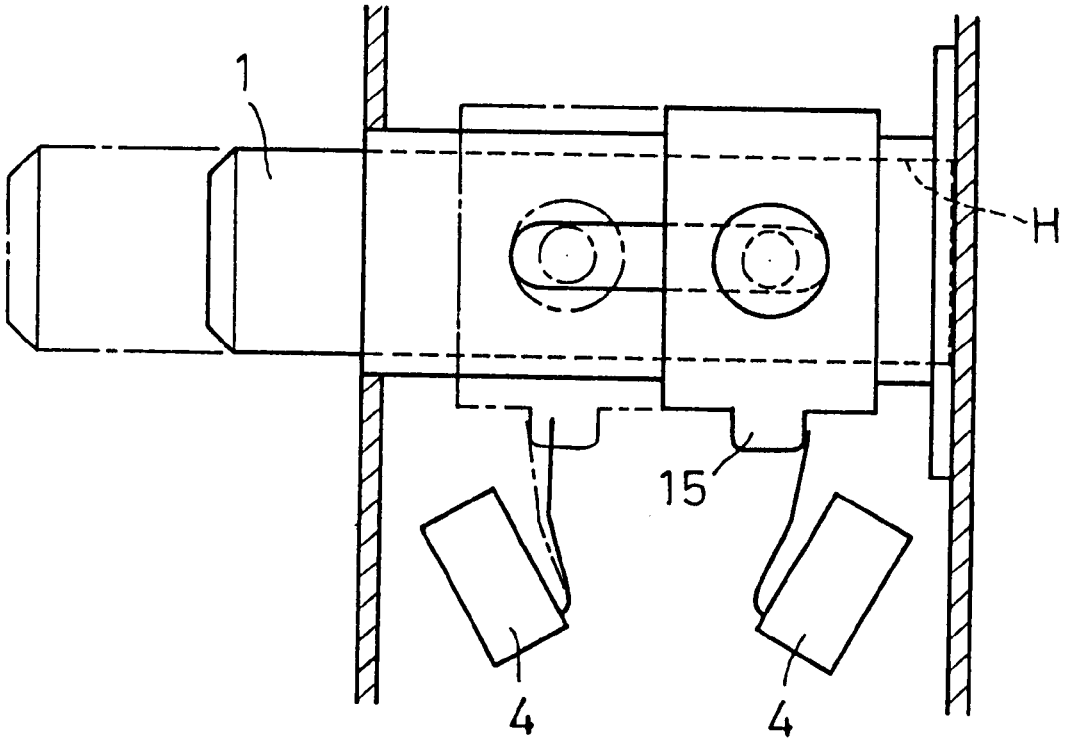
FIG. 4 is a view for explaining the operation of the sensor switch.

In this embodiment, the sensor switch 4 has two microswitches mounted on fittings and brought into engagement with protrusions 15 provided on the bolt 1 as shown in FIG. 4 to detect the position (top and bottom dead points) of the bolt 1. The output of each switch is connected to a microcomputer 20 described later.

The circuit board 5 has a wireless receiver means, drive means, alarm means, first voltage detecting means, second voltage detecting means, power supply means and ID identifying means.

Figure 5:
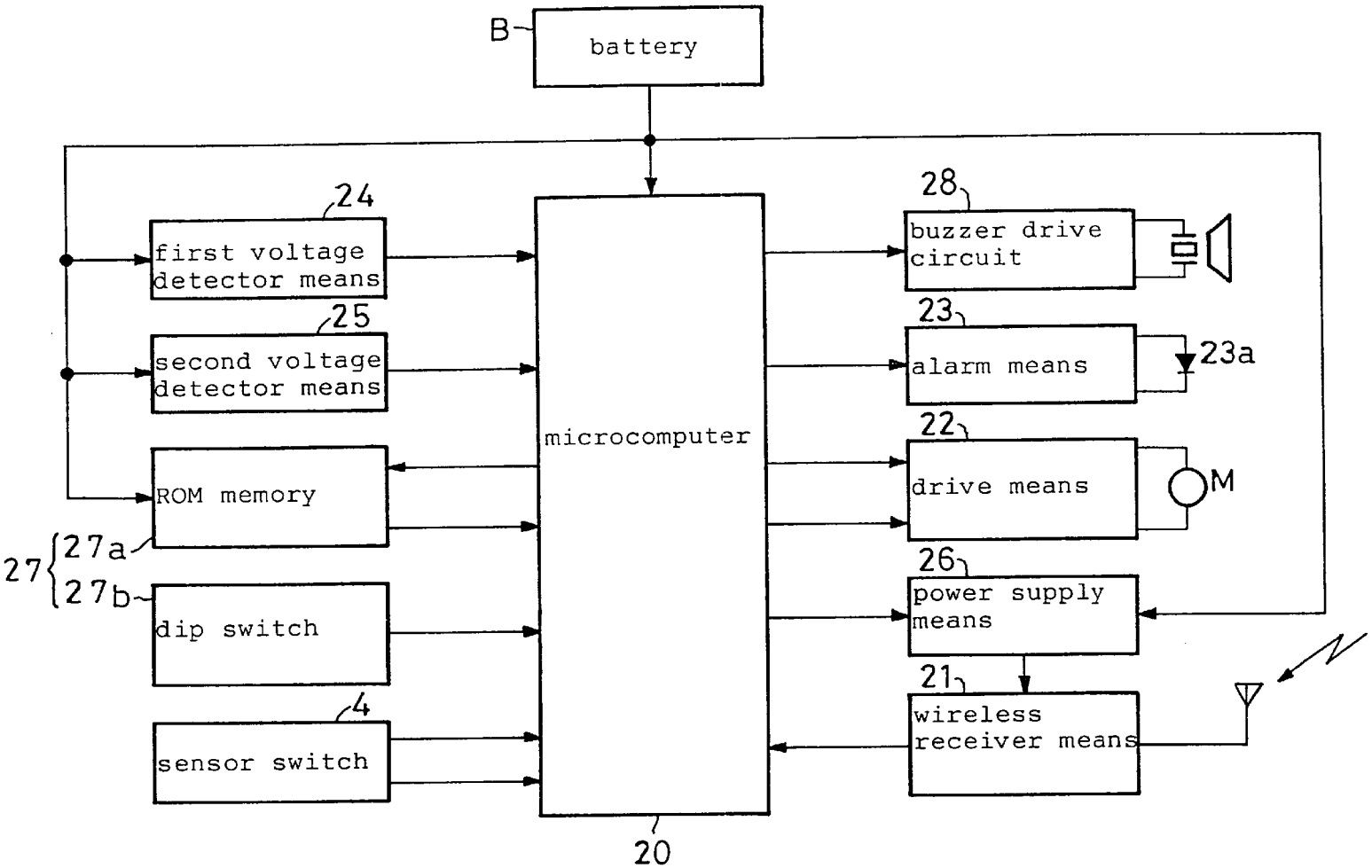
FIG. 5 is a block diagram of the auxiliary lock body.
Figure 6:
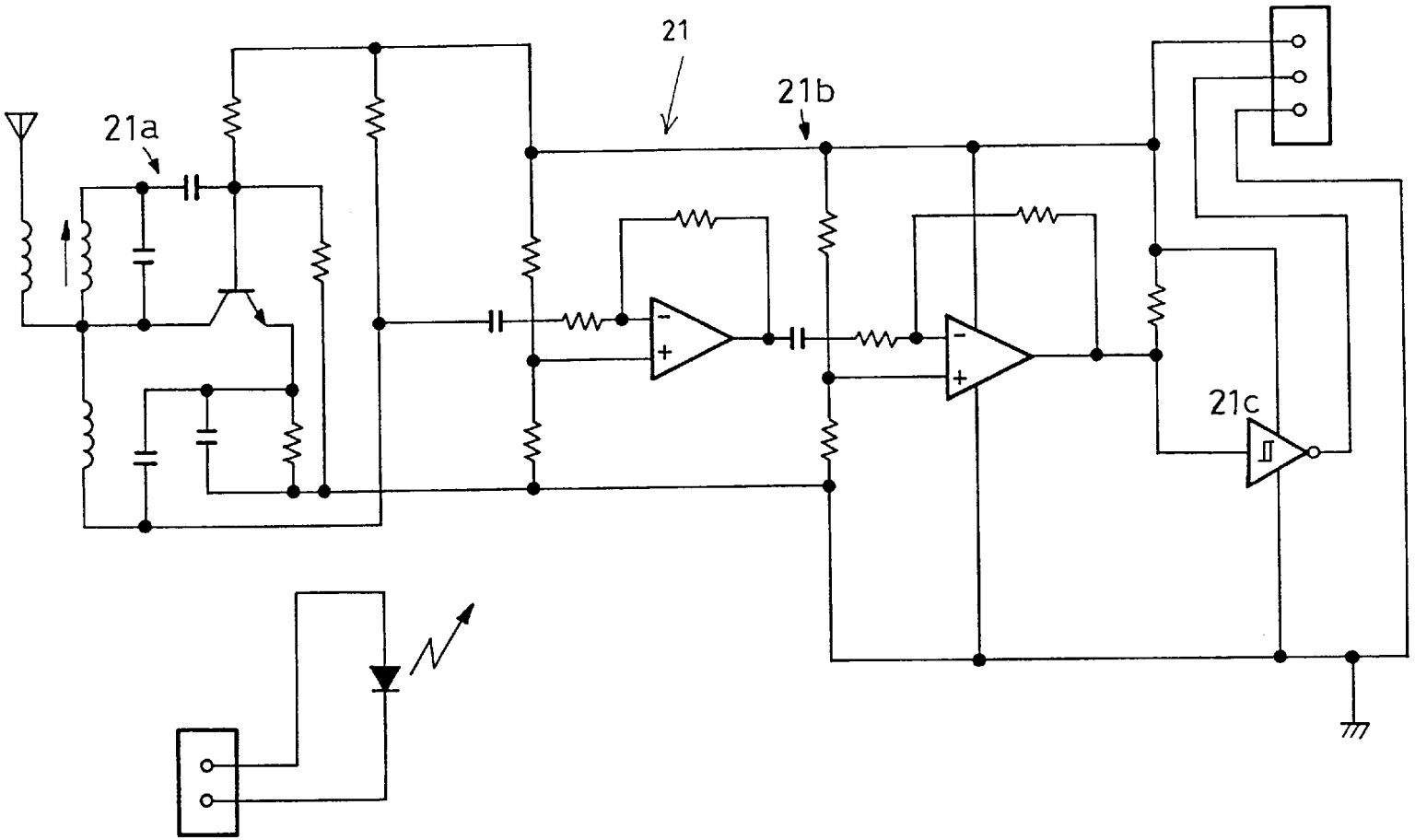
FIG. 6 is a circuit diagram of the wireless receiver means.
Figure 7:
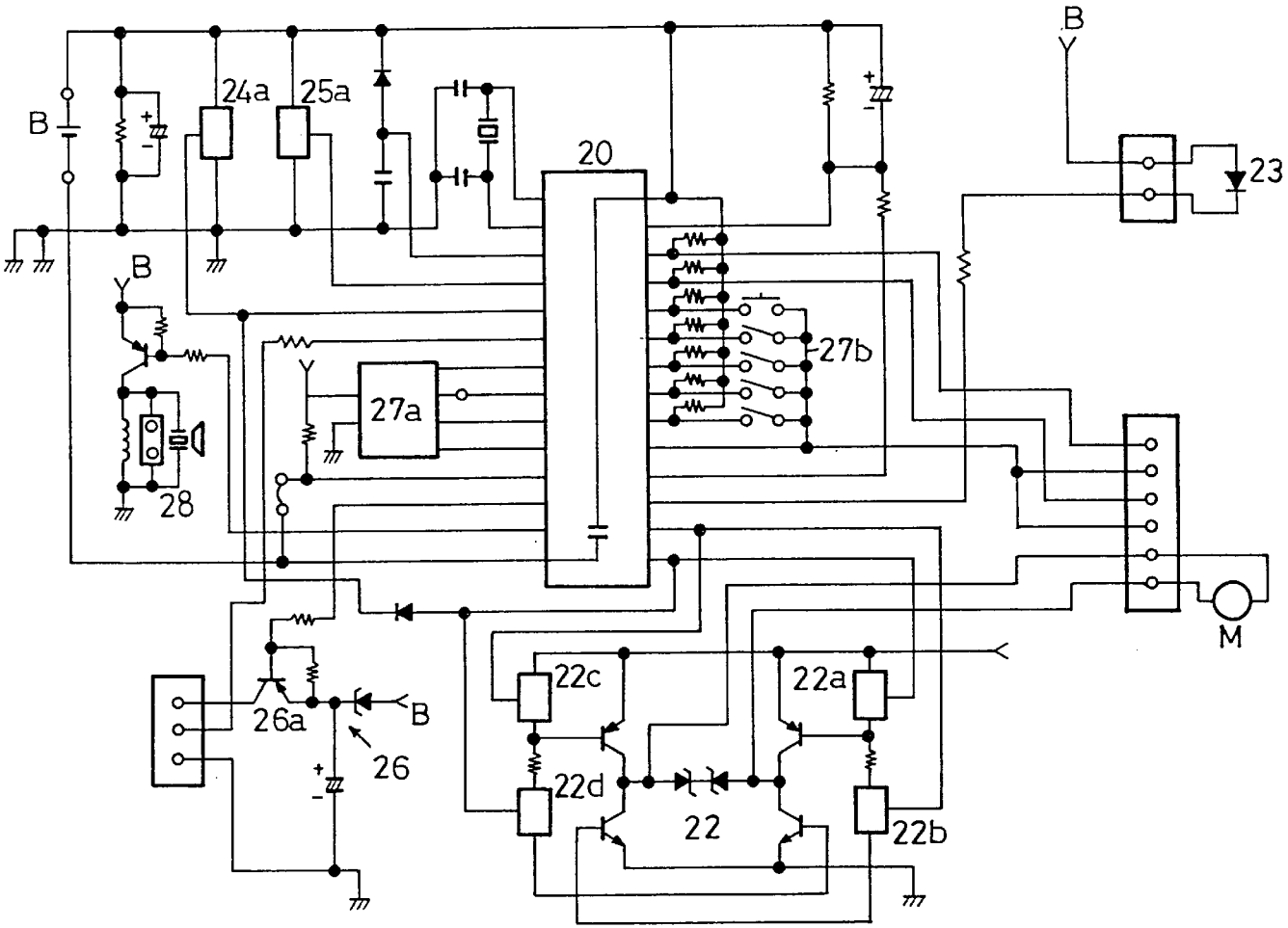
FIG. 7 is a circuit diagram of the drive circuit.

Specifically, as shown in FIGS. 5–7, by connecting interface circuits to the microcomputer 20 (one-chip microcomputer having halt and timer functions), the above-said means are formed.

That is, as shown in FIG. 6, the wireless receiver means 21 is formed of a tuning detector circuit 21*a*, an amplifier circuit 21*b* and a waveform shaping circuit 21*c*. By detecting signals from the wireless remote controller R, amplifying the detection signals in the amplifier circuit 21*b*, and inputting them into the waveform shaping circuit 21*c*, ID code signals (pulse train signals) as described below are inputted into the microcomputer 20.

As shown in FIG. 7, the drive circuit 22 has a normal/reverse turn circuit (using bridge connection) connected to the microcomputer 20 through drive ICs 22*a*–22*d* and is adapted to drive the motor M of the actuator 3 forwardly and backwardly in response to the output of the microcomputer 20.

The alarm means 23 has an LED 23*a* connected to the microcomputer 20 through a current limiting resistor and is turned on and off by the output of the microcomputer 20.

The first voltage detector means 24 uses a power source voltage monitoring IC 24*a* having a predetermined reference voltage, which is 2.6 V in this embodiment, and outputs a detection signal to the microcomputer 20 if the voltage of the battery B has dropped below the reference voltage 2.6 V, by connecting the IC 24*a* to the microcomputer 20.

The second voltage detector means 25 uses a power source voltage monitoring IC 25*a* having a predetermined reference voltage of 2.4 V, and outputs a detection signal to the microcomputer 20 if the voltage of the battery B has dropped below the reference voltage 2.4 V.

The reference voltage of the second voltage detector means 25 is set at 2.4 V in view of the minimum driving voltage of the motor M to push down the bolt 1 below the lock surface J by driving the actuator 3. According to the characteristics of the motor M, it may be suitably determined.

The power supply means 26 serves to intermittently supply power from the battery B to the wireless receiver means 21. As shown in FIG. 7, it has a switching transistor 26*a* provided in series between the battery B and the wireless receiver means 21 to control the supply of power to the wireless receiver means 21 by controlling turning on and off of the switching transistor 26*a* by the microcomputer 20.

By intermittently activating the wireless receiver means 21 instead of keeping it on, exhaustion of the battery B can be retarded.

In this embodiment, the ID identifying means 27 comprises a ROM memory 27*a* connected to the microcomputer 20 and a dip switch 27*b* for setting. ID codes are stored in the ROM memory 27*a*. When an address is set on the dip switch 27*b*, the microcomputer 20 reads in the IC code of the address thus set of the ROM memory 27*a*, and identifies the wireless remote control R based on the ID code.

Numeral 28 in the figures is a buzzer driving circuit for producing a confirmation sound or an alarm when abnormality occurs.

Figure 8:
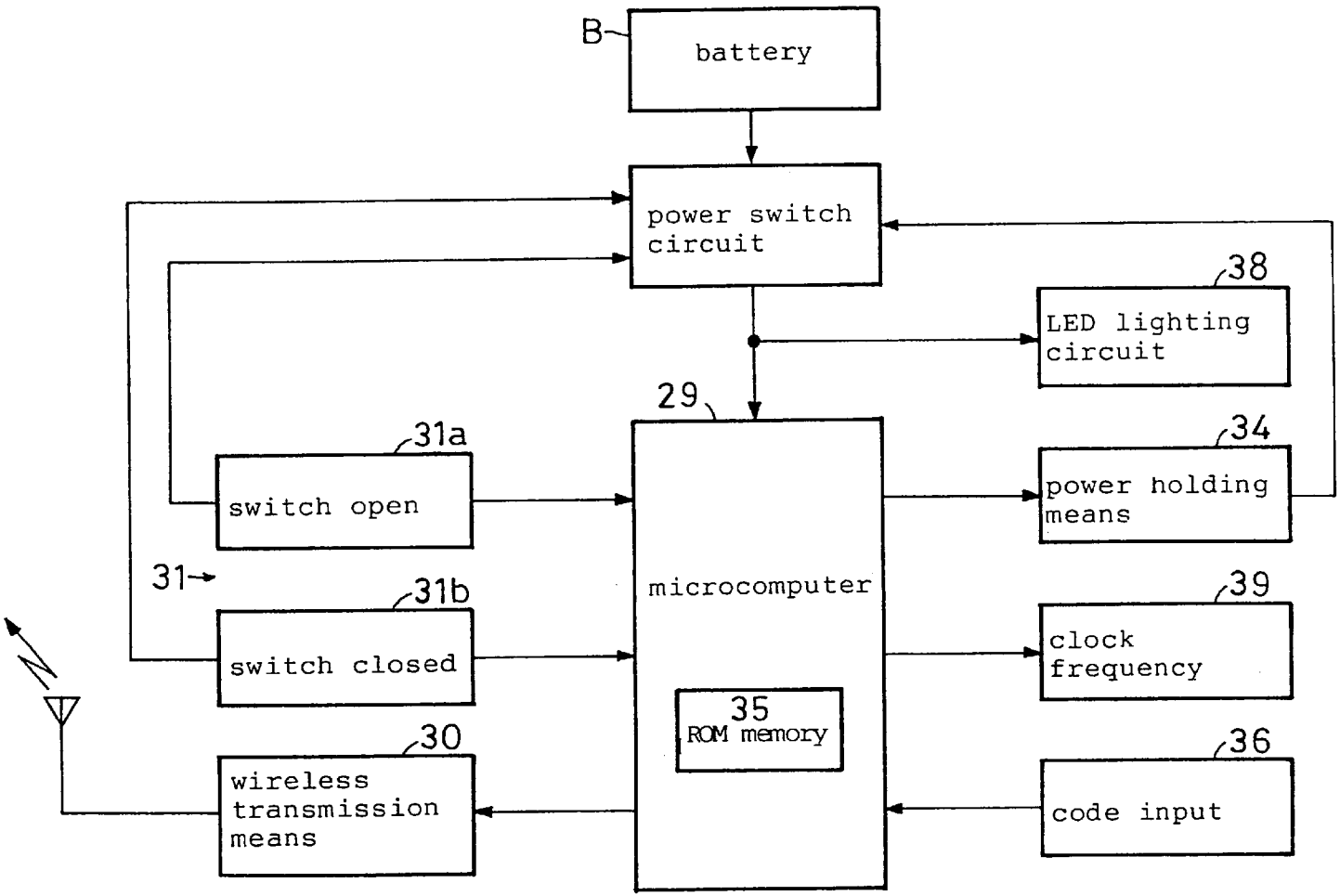
FIG. 8 is a block diagram of the wireless remote controller.

On the other hand, as shown in FIG. 8, the wireless remote controller R is comprised of a wireless transmission means 30, an on-off signal producing means 31 and a power holding means 34.

Figure 9:
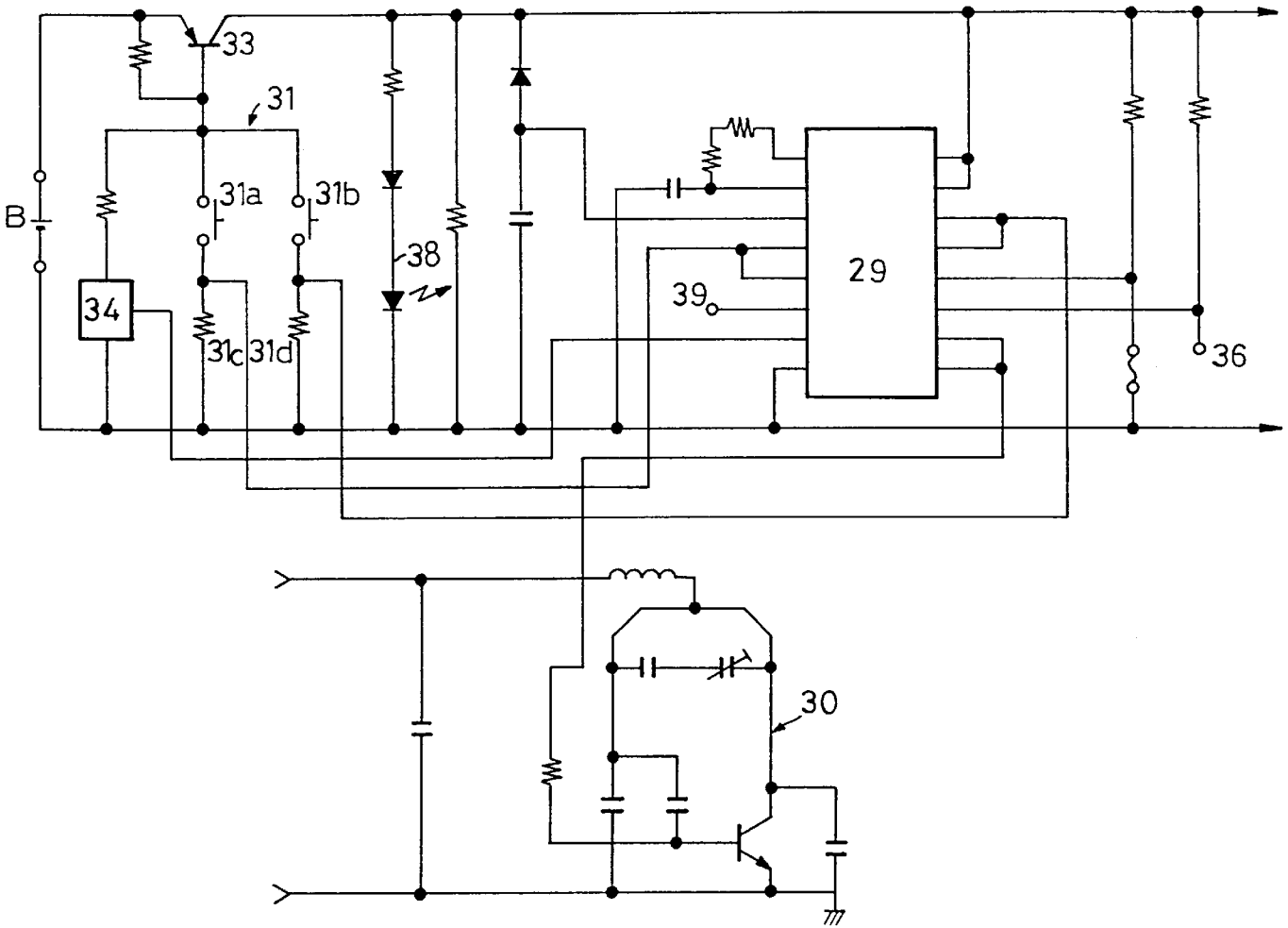
FIG. 9 is a circuit diagram of the same.

As shown in FIG. 9, the wireless transmission means 30 comprises an amplitude modulation circuit using a transistor. As a modulation signal, an ID code output is outputted from the microprocessor 29 to the transistor of the amplitude modulation circuit.

The on-off signal producing means 31 is a switch circuit comprising switches 31*a* and 31*b* and resistors 31*c* and 31*d*. As shown in FIG. 9, by pressing the switch 31*a* (open button) or switch 31*b* (close button), which are connected to the microcomputer 29, the microcomputer outputs an on-off signal.

Also, as shown in FIG. 9, the switch circuit is connected to a base circuit of a switching transistor 33 connected in series with the battery B. By pressing one of the switches 31*a* or 31*b* of either switch circuit, the switching transistor 33 is activated to supply power.

In parallel to the switch circuit of the on-off signal producing means 31, an IC for holding power as the power holding means 34 is connected to the switching transistor 33. The IC 34 is connected to a microcomputer 29 to turn off the switching transistor 33 with a stop signal which is outputted after the microcomputer 29 has completed transmitting signals.

With this arrangement, electric power is supplied only while the remote controller R is being operated, thereby suppressing unnecessary consumption of the battery, so that the lock can be used for a longer period of time.

On the other hand, the microcomputer 29 has a built-in ROM memory 35 and is programmed such that ID codes are stored in the memory 35. When ID codes are loaded into the microcomputer 29 through a code input terminal 36 shown in FIG. 9, they can be set in the builtin ROM memory 35.

Numeral 38 is a pilot lamp circuit using an LED and numeral 39 is a clock adjusting terminal.

The auxiliary lock body A is mounted e.g. to the inside of a door as shown in FIG. 1. The lock seat 2 is mounted on the doorframe of the door so as to oppose to the bolt of the auxiliary lock body A.

Now, because an ID code for a corresponding wireless remote control R is set beforehand by the dip switch 27*b* for setting an ID address, the lock can be controlled only by the specific remote control R.

Figure 10:
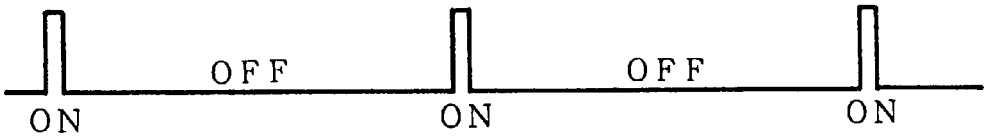
FIG. 10 is a power waveform of the auxiliary lock body.

In the thus mounted auxiliary lock body A, only during the ON periods shown in FIG. 10, electric power is supplied to the wireless receiver means 21 by the power supply means 26, which is connected to the microcomputer 20, to receive the ID code from the wireless remote controller R. During other periods, the microcomputer 20 activates only a built-in timer with all the circuits kept in a holding state (power off) to reduce power consumption. Thus, the battery B can work for a long time.

In this state, if the switch 31*a* (close button) of the wireless remote controller R is pressed, the wireless remote controller R is turned on. When this is detected by the microcomputer 29, it transmits an ID code from the wireless remote controller R.

Figure 11:
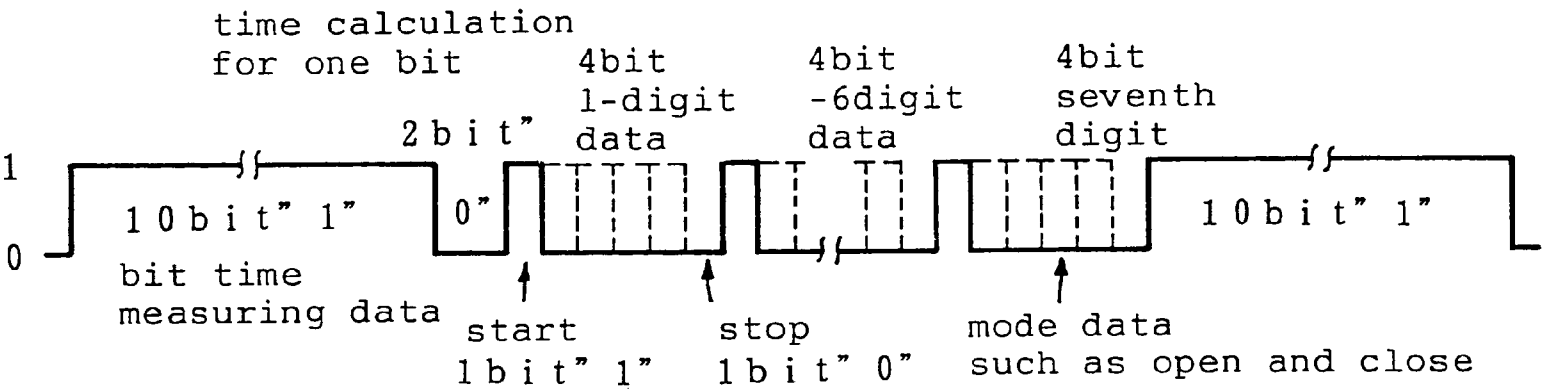
FIG. 11 is a view slowing the ID code of the transmission signal.

In this embodiment, as shown in FIG. 11, the ID code comprises a 7-digit code signal, each digit including 4 bits. The first to 6th digits of the 7 digits are used as ID signals for distinguishing, and the 7th digit is used as a mode signal such as opening or closing. Also, by providing 10-bit synchronizing signals before and after the 7-digit code signal, it is possible to search for the signal by measuring the time of "1" of the 10-bit synchronizing signals and then calculating the time per bit even if e.g. the pulse width of one bit changes with temperature or voltage.

When the auxiliary lock body A receives the ID code, the sensor switch 4 detects the position of the bolt 1. When it detects that the bolt 1 is in its open position, the actuator 3 is operated by the drive circuit 22 to move the bolt 1 until a closed state is detected by the sensor switch 4.

Similarly, when e.g. the switch 31*b* (open button) of the remote controller R is pressed, the auxiliary lock body A detects the position of the bolt 1. When it is detected that the bolt is closed, the bolt 1 is moved until its open state is detected by the sensor switch 4.

Otherwise, because an ID code is an invalid command, even if received, it is not entered.

Thus, since opening and closing are controlled by the wireless remote controller R, it is not necessary to use a conventional key. Because no keyhole is needed, the lock cannot be opened from outside even if a tool is used. Also, since it can be opened with one action, locking and unlocking are less time-consuming.

If it is adapted such that the body will not be activated unless it receives identical ID signals when the switch 31*a* (close button) or switch 31*b* (open button) of the wireless remote controller R is operated twice (or N times) at a constant speed, it is possible to easily insure security by modifying the operating method of the remote controller R.

By carrying out opening and closing of the lock as above, the battery B of the auxiliary lock body A will exhaust and the voltage will lower. When the first voltage detecting means 24 detects such lowering (to about 2.6 V here), the detection output is outputted to the microcomputer 20. Then, the microcomputer 20 causes the LED 23*a* to blink at intervals of 2–3 seconds through an LED lighting circuit as the alarm means 23 to urge replacement of the battery B.

At this time, if the battery B is not replaced and the voltage lowers further (to around 2.4 V), the second voltage detecting means 25 detects the lowered voltage and outputs it to the microcomputer 20. Thus, the microcomputer 20 first detects the position of the bolt 1 through the sensor switch 4. If it detects that the position of the bolt 1 is in a closed state, it activates the actuator 3 through the drive circuit 22 to move the bolt 1 until the sensor switch 4 detects an open state of the bolt, thereby housing it inside the lock surface J. Simultaneously, the LED activating circuit as the alarm means 23 turns on the LED 23*a* to notify this fact.

Thus, since the lock can be opened by lowering the bolt 1 inside the lock surface J before the voltage of the battery B lowers so much that the actuator 3 is deactivated, even if the battery dies, it is not possible that the door cannot be opened.

According to this invention, since the lock is opened before the battery dies by detecting the voltage of the battery, even if the battery dies, it is possible to open the door.

Also, since electric power is supplied intermittently to the wireless receiver circuit, the lock can be used for a long time even with a battery.

What is claimed is:

1. A remote controlled auxiliary lock comprising an auxiliary lock body to be mounted to a door, and a wireless remote controller, said lock body comprising a bolt protrudable from a lock surface, an actuator for actuating said bolt, a lock seat engageable with said bolt, and a built-in battery for activating said actuator, said auxiliary lock body comprising a wireless receiver means, a drive means for activating said actuator when said wireless receiver means receives an open-close signal from said wireless remote controller, a first voltage detecting means and a second voltage detecting means for detecting that the voltage of said battery has lowered to respective predetermined voltages, and an alarm means, said wireless remote controller comprising a wireless transmission means and an open-close signal generating means for sending said open-close signal to said wireless transmission means, wherein when said first voltage detecting means detects that the voltage of said battery has dropped to a predetermined first voltage, an alarm is generated by said alarm means, and when said second voltage detecting means detects that the voltage of said battery has dropped further to a predetermined second voltage, said actuator is activated to push down said bolt inside the lock surface.

2. The remote controlled type auxiliary lock as claimed in claim 1 wherein said auxiliary lock body comprises an electric power supply means for intermittently supplying electric power from said battery to said wireless receiver means.

3. The remote controlled auxiliary lock as claimed in claim 1 wherein said actuator is motor-driven through a clutch mechanism.

4. The remote controlled auxiliary lock as claimed in claim 1 wherein said auxiliary lock body comprises an ID identifying means, and wherein said wireless remote controller comprises an ID signal generating means.

5. The remote controlled auxiliary lock as claimed in claim 2 wherein said actuator is motor-driven through a clutch mechanism.

6. The remote controlled auxiliary lock as claimed in claim 2 wherein said auxiliary lock body comprises an ID identifying means, and wherein said wireless remote controller comprises an ID signal generating means.

7. The remote controlled auxiliary lock as claimed in claim 3 wherein said auxiliary lock body comprises an ID identifying means, and wherein said wireless remote controller comprises an ID signal generating means.

* * * * *